US006050675A

United States Patent [19]

Bartolome

[11] Patent Number: 6,050,675

[45] **Date of Patent: *Apr. 18, 2000**

[54] METHOD FOR OPERATING AN INK JET PRINTER AND INK JET PRINTER USING THE METHOD

[75] Inventor: Emiliano Bartolome, Barcelona, Spain

[73] Assignee: Hewlett-Packard Company, Fort Collins, Colo.

[ * ] Notice: This patent is subject to a terminal disclaimer.

[21] Appl. No.: 09/289,404

[22] Filed: Apr. 10, 1999

Related U.S. Application Data

[62] Division of application No. 08/705,101, Aug. 28, 1996, Pat. No. 5,929,876.

[30] Foreign Application Priority Data

Sep. 8, 1995 [EP] European Pat. Off. ..... 95114111

[51] Int. Cl.[7] ..... B41J 2/145

[52] U.S. Cl. ..... 347/41

[58] Field of Search ..... 347/41, 20, 14, 347/15, 12, 9, 19, 5, 40

[56] References Cited

U.S. PATENT DOCUMENTS

| | | | |
|---|---|---|---|
| 4,374,388 | 2/1983 | Heinzl | 347/15 |
| 4,999,646 | 3/1991 | Trask | 347/41 |
| 5,132,702 | 7/1992 | Shiozaki et al. | 347/12 |
| 5,448,269 | 9/1995 | Beauchamp et al. | 347/14 |
| 5,929,876 | 7/1999 | Bartolome | 347/20 |

FOREIGN PATENT DOCUMENTS

| | | |
|---|---|---|
| 0595657A3 | 10/1993 | European Pat. Off. . |
| 0622238A3 | 4/1994 | European Pat. Off. . |
| 62-92851 | 4/1987 | Japan . |

*Primary Examiner*—N. Le
*Assistant Examiner*—Judy Nguyen
*Attorney, Agent, or Firm*—Ohlandt, Greeley, Ruggiero & Perle, L.L.P.

[57] ABSTRACT

In a method for operating an ink jet printer with a curved platen the firing of the ink nozzles of the print heal is controlled in a specific way to avoid the effects of misplacement of ink dots on the printing medium due to the curvature of the platen and other effects. The printing of markings on the printing medium is performed in several passes of the print head whereby the medium is advanced between passes. During a pass, central nozzles are fired more often than nozzles at the periphery of the print head because the precision for peripheral nozzles is worse than for central nozzles. Printing during a single pass is thus performed in bands whereby the amount of ink placed in central bands is higher than in peripheral bands.

5 Claims, 9 Drawing Sheets

METHOD FOR OPERATING AN INK JET PRINTER AND INK JET PRINTER USING THE METHOD

This is a request for a filing under 37 CFR 1.53(b), for a: Division of prior application Ser. No. 08/705,101 filed Aug. 28, 1996 U.S. Pat. No. 5,929,876.

FIELD OF THE INVENTION

The invention relates to a method for operating an ink jet printer, in particular an ink jet printer which has a curved platen. The invention also relates to an ink jet printer with a curved platen using such a method.

DESCRIPTION OF THE PRIOR ART

Ink jet printers fire droplets of ink toward a printing medium, such as paper or vellum, thus forming ink dots on the medium. The firing of ink droplets may be done by piezoelectric means or by resistive heating (thermal ink jet). Ink jet printers are known, for example, from U.S. Pat. No. 4,855,752 or from U.S. Pat. No. 4,967,203 or from U.S. Pat. No. 5,376,956. From this prior art, it is also known to use a print head with a plurality of nozzles from which the ink is ejected under the control of a computer. The nozzles are typically arranged in arrays, for example in parallel columns of several equidistant nozzles. The print head is typically designed as a replaceable cartridge filled with the printing ink and comprising suitable electric connections to the printer. The print head is arranged in a printer carriage which is movable in a direction across the printing medium whereas the medium can be moved in a direction perpendicular to the movement of the carriage.

The component of the printer on which the printing medium (e.g. paper) rests when ink droplets are fired, is called platen. The platen may be flat or curved. A curved platen may have the shape of a circular segment, for instance. In a printer with a curved platen it may come to problems with the print quality as will be explained in the following. Since the portion of the print head on which the nozzles are arranged is flat and since the platen is curved, the distance between the nozles and the printing medium is not constant for all the nozzles of the printing head and the dots are therefore not printed on the right positions. The error is bigger for the dots printed with the nozzles at the periphery of the print head than for those printed with the nozzles at the center of the print head.

FIG. 1 illustrates the mentioned situation wherein a print head 1 is arranged over a curved platen 2. The face of the print head where the nozzles are arranged is a flat surface 3. D1 denotes the distance between the print head and the platen for a central nozzle and D2 denotes the distance between a nozzle at the periphery and the platen. There is a second effect due to the different flying times for drops fired with the central nozzles and those fired with peripheral nozzles. As a result, there are two errors when the paper is unrolled after printing:

a) Horizontal lines that should be equally spaced do not have the same distance.

b) Due to the different flight times for different nozzles, there is a discrepancy between the position where the drop should fall to produce the correct print image and the position where the drop really falls.

FIG. 2 illustrates the influence of the varying distance between the print head 1 and the printing medium 4, 4 on the position of the ink dot 5, 5 placed on the medium. FIG. 3 illustrates where an ink drop falls for a central nozzle, where it should fall for an outer nozzle and where it actually falls for an outer nozzle. Circle 6 in FIG. 3 corresponds to the theoretical and real position of an ink dot on the medium produced by a central nozzle. Circles 7 to 9 describe the situation for an outer nozzle, wherein circle 7 is the theoretical position where the drop should fall, circle 8 illustrates the error due to the curvature of the platen and circle 9 illustrates the combined error due to curvature and movement of the carriage.

FIGS. 4 and 5 are further illustrations of the errors caused by the curvature of the platen. Shown are ink dots on the medium produced by the nozzles of the print head. FIG. 4 shows that not all horizontal lines are at the same distance as should ideally be the case in this example. FIG. 5 shows that the vertical lines are not straight lines, but that they are curves instead. FIG. 5 shows both errors, i.e. unequal distances between horizontal lines and differences in flying time of the droplets.

SUMMARY OF THE INVENTION

In view of the prior art, it is an object of the invention to provide a method for operating an ink jet printer, in particular an ink jet printer with a curved platen, which has an increased accuracy of the dot placement on the printing medium.

It is a further object of the invention to provide a method for operating an ink jet printer which reduces the average error of dot placement without negative influence on the throughput of the printer.

Another object is to provide a method for operating an ink jet printer and a corresponding ink jet printer (or plotter) which ensures improved quality of the images and text printed on the printing medium.

According to the invention, the above mentioned objects are achieved for a method by the features of claim 1.

In accordance with an underlying principle of the invention, the area of the medium which may be imprinted with a single pass of the print head (swath) is subdivided into different bands, the swath is printed in several passes of the print head with short advances of the medium between different passes, wherein the amount of ink placed on the bands during a pass is larger for the central bands of a swath than for the peripheral bands of a swath. Since the errors in dot placement are smaller for the central nozzles of the print head than for the peripheral nozzles, the use of less ink at the peripheral bands of a swath leads in summary to a reduction of dot misplacement of the entire swath. Since each swath is printed in a plurality of passes, it is ensured that the amount of ink finally placed on the medium in each band corresponds to the full amount of ink (100%) to required for generating the desired image or letter or other marking. In other words, the central nozzles are used more often than the peripheral because the precision for the peripheral nozzles is worse.

In a preferred embodiment of the invention, each swath is divided into N bands, each band corresponding to n nozzles, the swath is printed in N passes, and the is printing medium is advanced after each path by a distance corresponding to 1/N of the height of the swath.

A further advantage of the invention is that it helps to reduce or eliminate the effects of misdirected nozzles due to problems in connection with manufacturing tolerances, lifetime of the print head, contamination in the nozzle orifice, etc. Furthermore, the effects of weak nozzles, i.e. nozzles that fire less ink than the nominal amount, are reduced.

BRIEF DESCRIPTION OF THE DRAWINGS

Preferred embodiments of the invention will subsequently be explained with reference to the drawings, wherein.

DESCRIPTION OF THE PREFERRED EMBODIMENTS OF THE INVENTION

Figure 1:
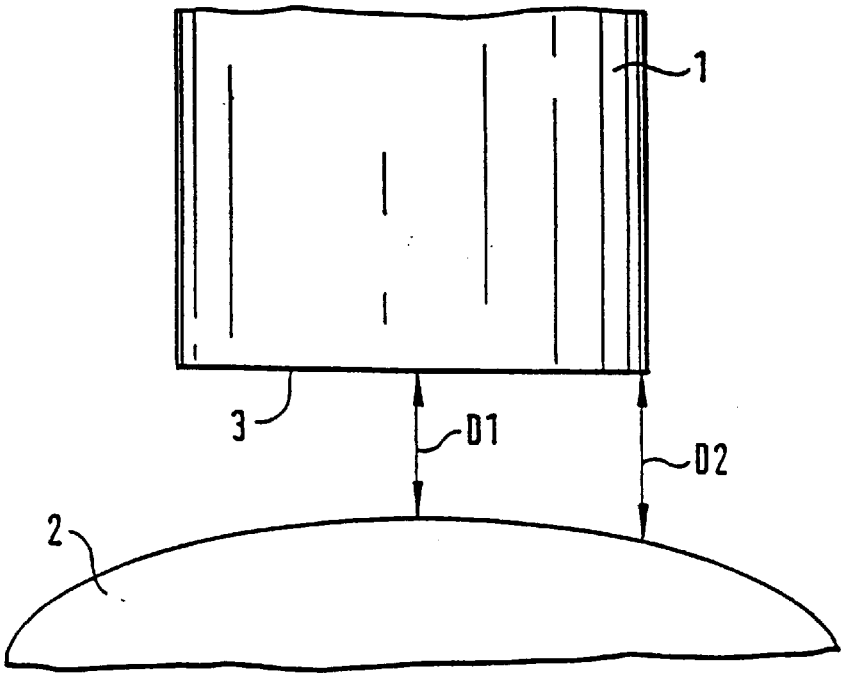
FIG. 1, is a schematic representation of a print head arranged over a platen for illustrating the problem solved by the invention.
Figure 2:
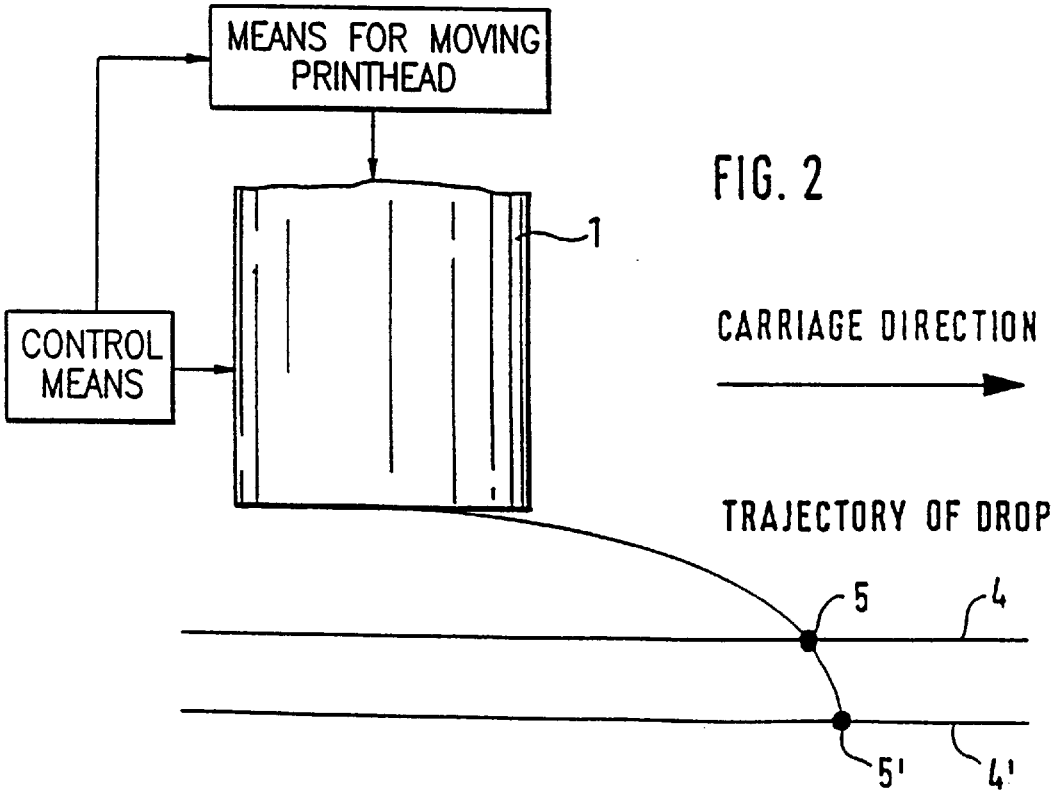
FIG. 2 schematically shows a print head above a printing medium for explaining the problems present in the prior art.
Figure 3:
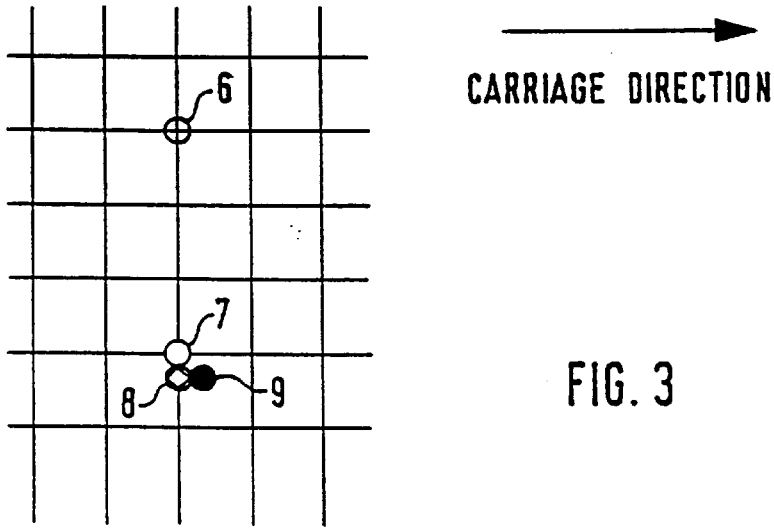
FIG. 3 shows theoretical and real positions of ink dots on the printing medium.
Figure 4:
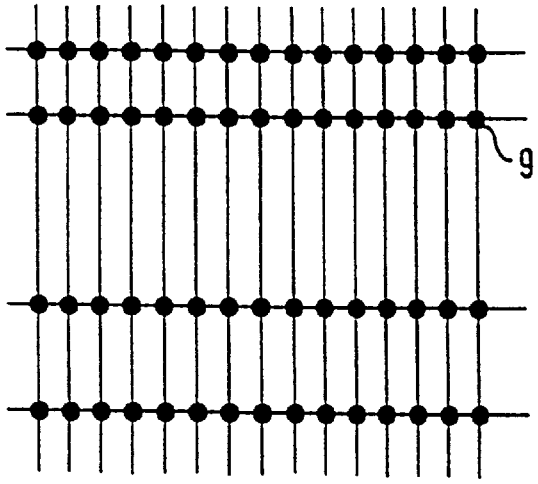
FIG. 4 shows ink dots on a printing medium to illustrate a prior art problem leading to errors in the spacing of horizontal lines.
Figure 5:
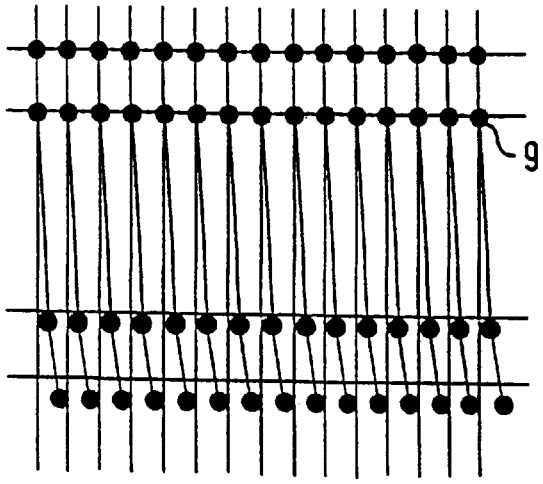
FIG. 5 shows ink dots on a printing medium to illustrate a prior art problem leading to curvature of vertical lines.
Figure 6:
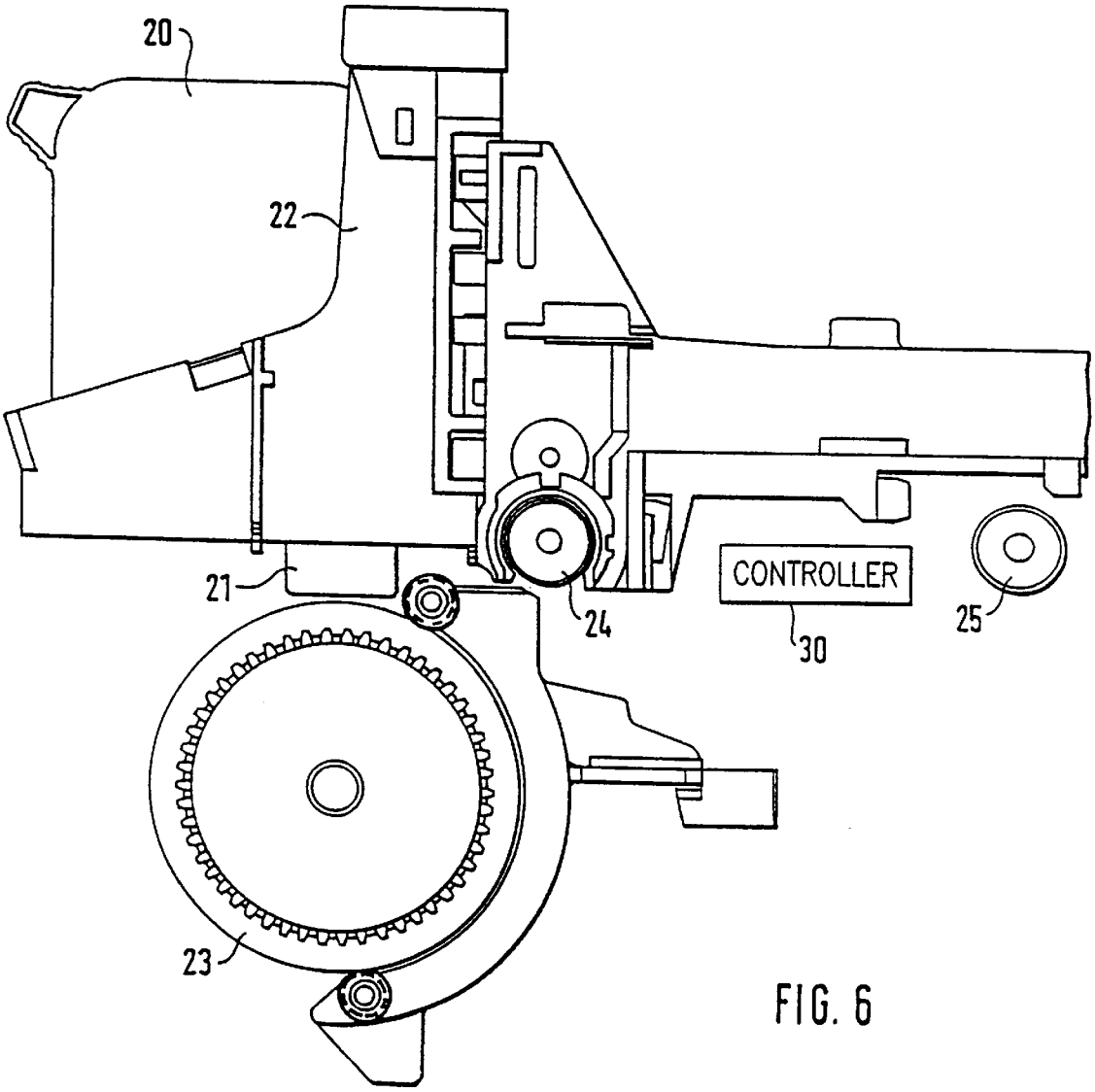
FIG. 6 is a schematic diagram of an ink jet printer with a curved platen according to an embodiment of the invention.

FIG. 6 shows some main parts of an ink jet printer with a curved platen according to an embodiment of the present invention. A central part of the printer is the print head 20 with an integral nozzle plate 21. The print head 20 is designed as a replaceable cartridge which contains the printing ink. The nozzle plate 21 carries a plurality of nozzles from which the ink is fired onto the printing medium. Further details of the print head will be described below with reference to FIGS. 7 and 8.

A platen 23 on which a sheet or roll of printing medium (e.g. paper) may rest, is arranged opposite to the nozzle plate 21. A carriage 22 for receiving the print head 20 is mounted on elongated guiding elements 24 and 25. The guiding elements are arranged parallel to the platen and perpendicular to the path of the medium. The carriage 22 may comprise several compartments to receive more than just the one print head 20 shown in FIG. 6. Such additional print heads which may contain inks of different colors, would be arranged in parallel to the print head 20.

Figure 7:
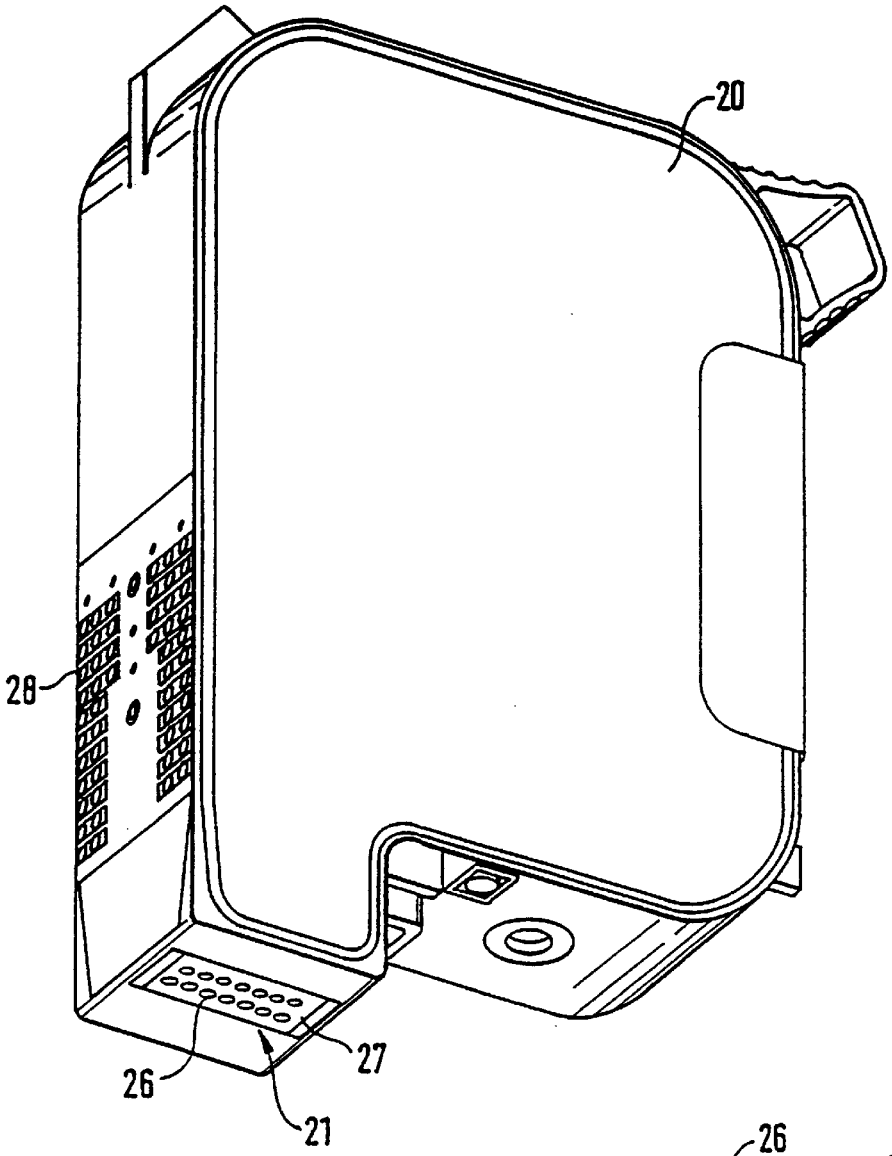
FIG. 7 is a detailed view of the print head shown in FIG. 6.
Figure 8:
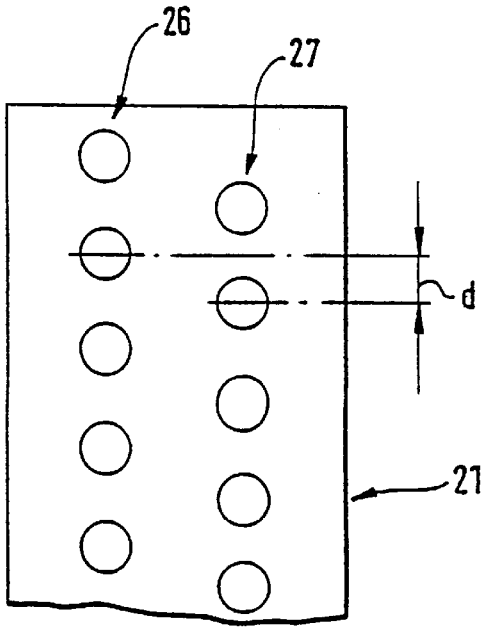
FIG. 8 shows a portion of the nozzle plate of the print head of FIG. 7.

FIG. 7 shows the print head 20 in more detail. The print head comprises at its lower surface a nozzle plate 21 oriented parallel to and facing the platen 23 when inserted in the carriage 22. The nozzle plate includes two linear nozzle arrays 26 and 27. These arrays are parallel to each other and perpendicular to the direction of the print path. Each array is composed of a group of nozzles equally spaced at a distance two times the resolution of the printer. Odd numbered nozzles are in one line while the even numbered nozzles are in the other line. The distance between a line printed with the n th nozzle of the even column and the n th nozzle of the odd column is equal to the resolution of the printer. FIG. 8 illustrates the arrangement of nozzles in arrays 26 and 27 on the nozzle plate 21. The distance corresponds to the resolution of the printer. A typical resolution corresponds to 600 dpi (dots per inch). Referring again to FIG. 7, there is also shown an arrangement 28 of electrical contacts by means of which electrical connections to the control circuitry of the printer are established for controlling the firing of the nozzles.

The ink jet printer according to FIG. 6 includes a mechanism for depositing droplets of ink on the printing medium at any desired location (pixel). This is accomplished, under computer control, by providing a means for moving the medium in regular increments or steps. After each such step of the medium, the print head with the ink nozzles is moved across the medium in a direction perpendicular to the direction of the advance of the medium. At each step, each nozzle is ordered by the computer to either eject ink or to abstain from doing so. By repeating this process, every potential pixel location on the medium may be addressed.

With print heads having interlaced even/odd nozzles as shown in FIG. 8. the drawing of a vertical line is accomplished as follows: The carriage with the print head 20 is moved over the medium and when the first column of nozzles (depending if the carriage is moved from left to right or from right to left it will be the even or odd ) reaches the desired position, the nozzles are fired and later when the second column reaches the same position, the nozzles of this second column are fired. The droplets fired from the last column will be incident on the same vertical position and form dots which are interlaced with the first dots.

The printing of markings on the medium, for example a page of text or a drawing, requires the handling of data representing the markings. There are different file formats, some of them may be directly accepted by the printer, others should be translated. An example of a file format is HP-GL/2. At the end of the sequence required to print a file, this file must be translated to a bitmap (sequence of 0 and 1) that defines if a droplet is to be fired from a specific nozzle or not. This last format, which is independent of the initial one and is common to all of them, is called raster and the process of generating it is called rasterization.

Figure 9:
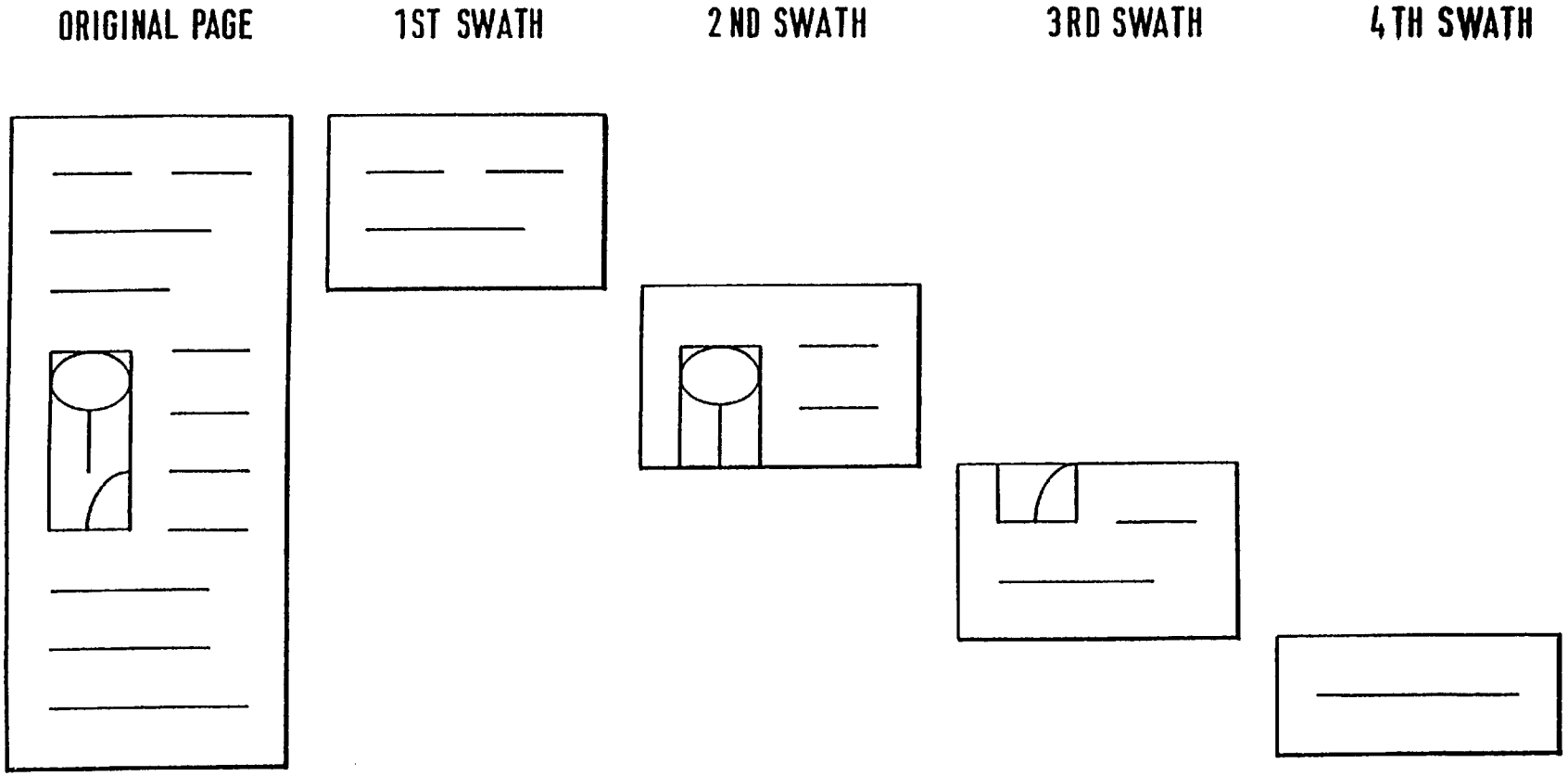
FIG. 9 illustrates the principle of printing in swaths.

Raster images could be very big since they depend on the size of the initial image, the resolution of the printer and the number of colors needed to print it. Since the amount of memory is limited, the driver or the firmware rasterizes a portion of the page at a time in a swath. Swaths are illustrated in FIG. 9. The size of this swath corresponds to the number of nozzles of the print head; the system rasterizes the amount of information that it is able to print in a single movement of the carriage. Each of these movements is called a print pass or, in short, a pass.

The user of the printer can typically select a set of parameters that allow to trade print quality for print speed. Generally, the printer lays down all the dots of a swath at a time, but sometimes it is advantageous to lay down the ink more slowly while distributing the ink in a single raster row among several different nozzles in the print head. This process will be explained in the following with reference to FIG. 10 and will be referred to as "shingling". The process of shingling is an element of the method according to the present invention as will become apparent below.

Figure 10:
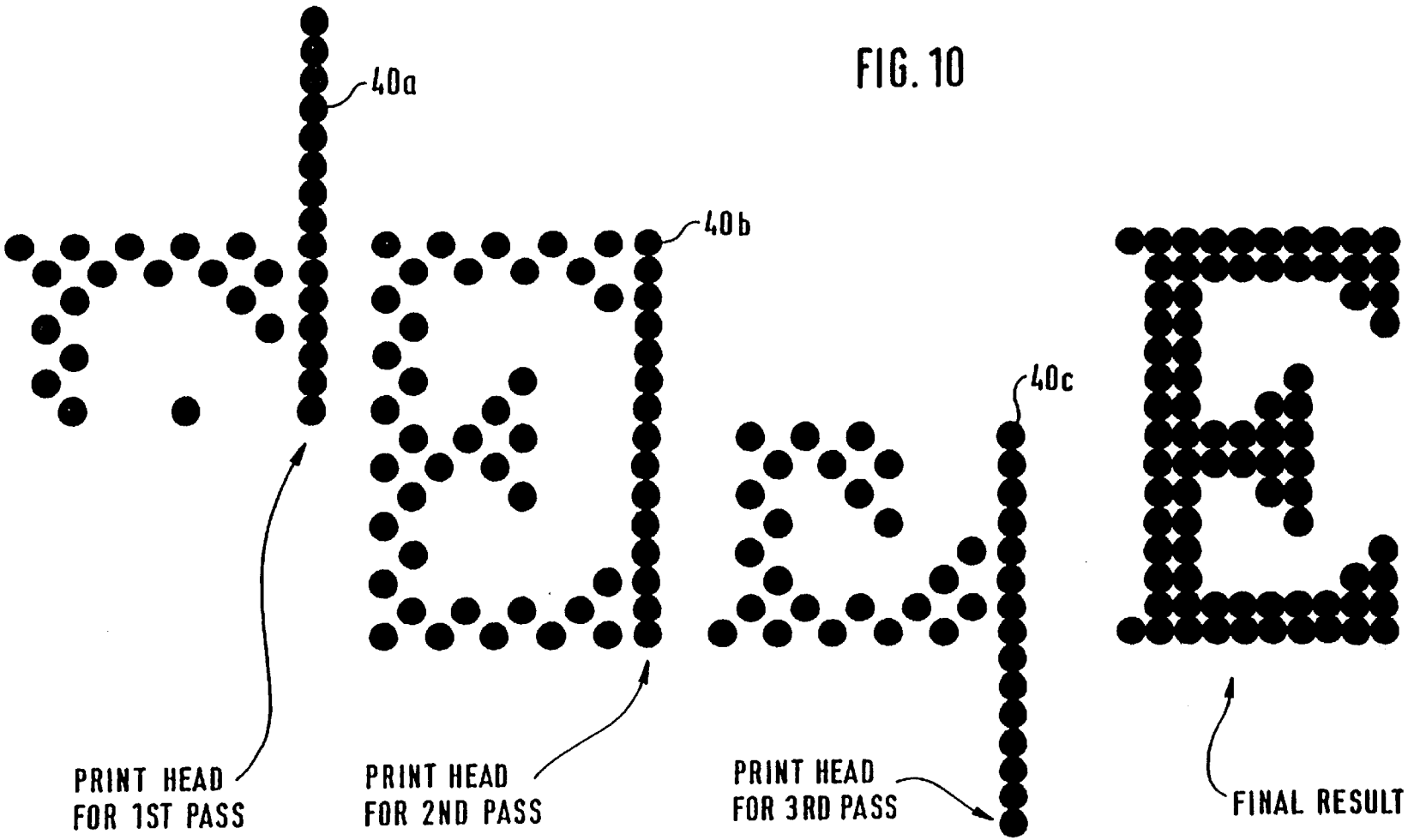
FIG. 10 illustrates the method of shingling in an ink jet printer.

When using shingling, several separate print passes are used to lay down the ink, whereby only a fraction of the dots in each raster row is printed during each print pass. Then the paper is advanced slightly and the further pixels representing the row are laid down. FIG. 10 illustrates the three passes needed to print the letter "E". For each of the three passes, the positions of the nozzles of the print head are indicated by reference numerals 40*a*, 40*b*, 40*c*, respectively, as well as the dots actually placed on the medium during each pass. When two passes are needed to print a swath, the amount of shingling is 50%, in case of four passes it is 25%, etc.

To obtain better performance, shingling is preferably performed by hardware. Performing it by software means that once the bitmap is generated, it is masked according to the desired shingling and copied to another memory position. This operation is to be executed as many times as there are passes. Performing shingling by hardware means that the copy is needed only once and the masking is done by programming certain registers; since the process of shingling does not change the bitmap to be printed, it is sufficient to reprogram the registers.

Figure 11:
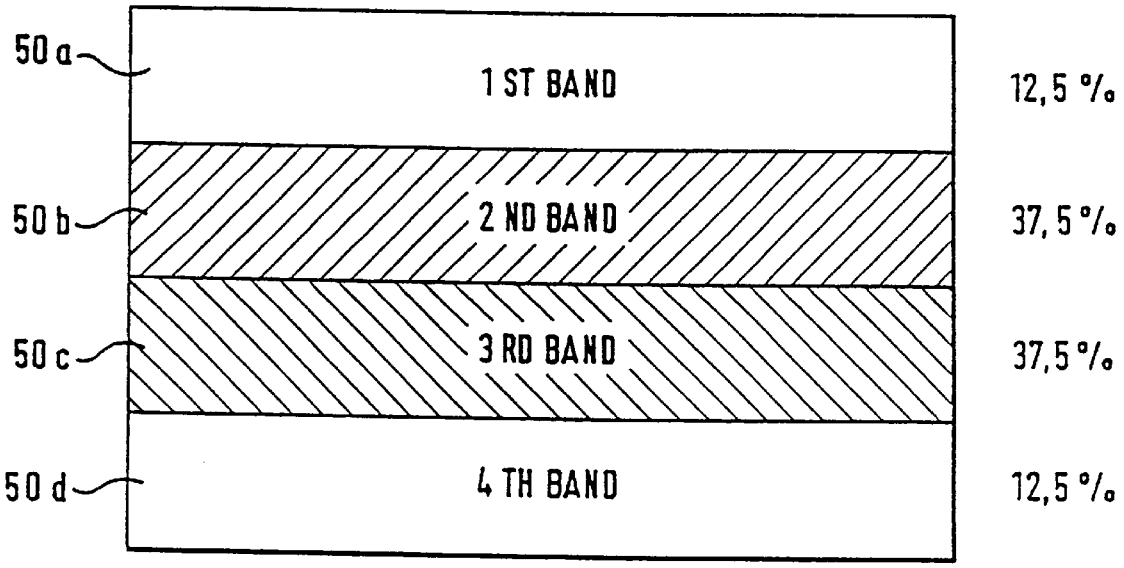
FIG. 11 schematically illustrates the principle of an embodiment of the invention wherein a swath is divided into several bands.

The basic idea for solving the problem underlying the present invention will now be explained with reference to FIG. 11. The method of the invention is based on shingling and it divides the swath in bands in which different percentages of ink are placed. In the example shown in FIG. 11, the swath is divided in four bands 50*a–d*. Each band is composed of the same amount of nozzles, i.e. each band has the same height. After one swath has been printed with the corresponding mask, the medium is advanced a distance equal to a band. The amounts of ink which the different bands receive are different from each other. The central bands receive more ink than the external ones. The masks are defined in such a way that after four passes 100% of ink has been fired. According to FIG. 11, the two central bands 50*b* and 50*c* each receive 37.5% ink during one pass, whereas the two peripheral bands 50*a* and 50*d* only receive 12.5% ink. After four passes, each portion on the printing medium where markings are to be made has received 100% ink (i.e. 12.5%+37.5%+37.5%+12.5%=100%). It can readily be understood that the measure to fire less ink in bands where the dot placement error is larger than in other bands leads to an improvement of the printing quality, provided the bands where little ink has been placed in a first pass of the print head are filled up with ink in a later pass by nozzles which lead to no or only little dot placement errors, i.e. by more central nozzles. This filling up is achieved in additional passes after appropriate advance of the medium.

Figure 12:
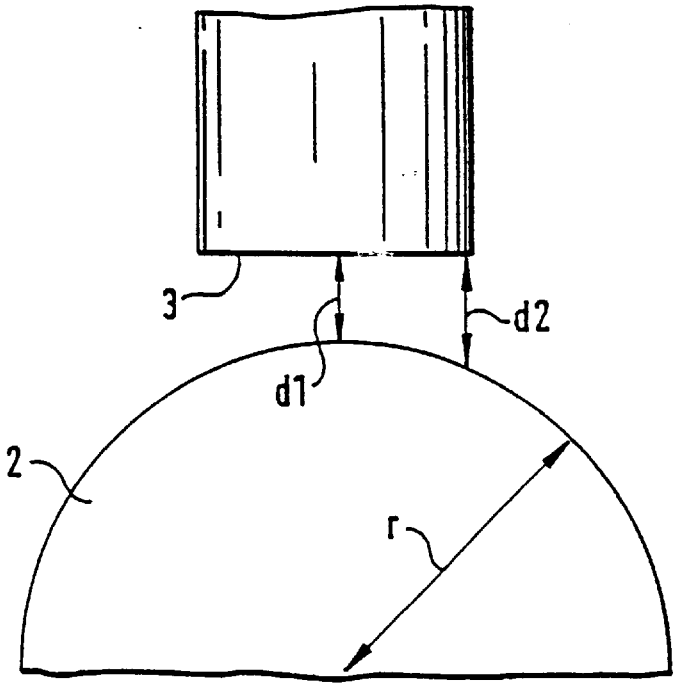
FIGS. 12 and 13 show geometric relations between print head, nozzles and curved platen, playing a role in deriving an error function.

In the following, a more detailed, mathematical explanation of the errors reduced or avoided by the present invention will be given. FIG. 12 shows the difference in distance between the nozzle plate 3 and the platen 2. The nominal distance d1 (the shorter one) corresponds to the distance between the central nozzle of the print head and the platen since the print head is centered over the platen. The maximum distance d2 applies for nozzles at the periphery of the print head. Since the nozles are equally spaced at the print head, it results that lines parallel to the trajectory of the carriage are not equally spaced when the printing medium is unrolled, thus causing a misplacement. A second error is associated with the different flying times for the droplets. The flying time depends on the distance and on other factors, such as initial speed (vertical), drag and gravity.

Figure 13:
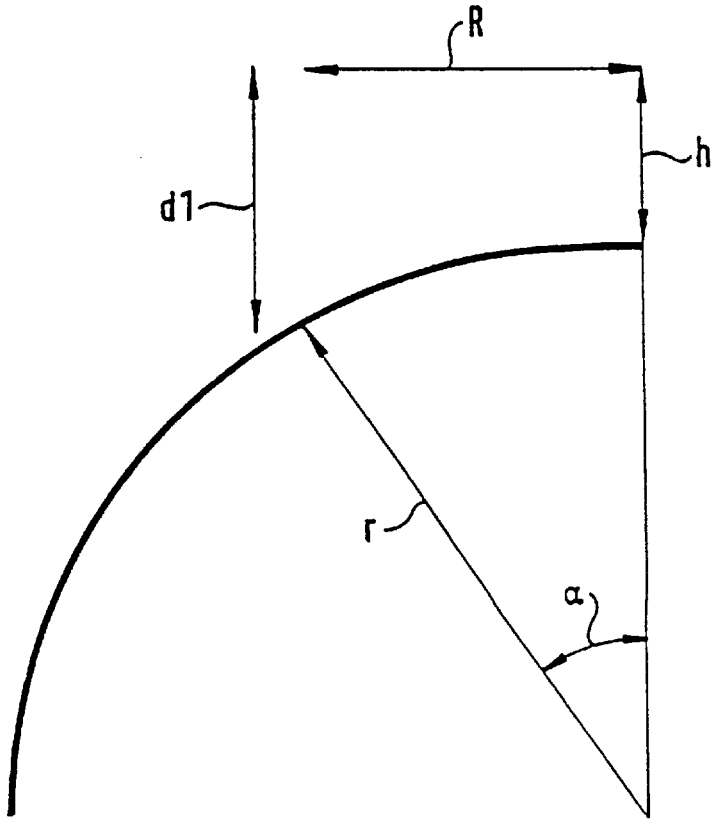

Referring to FIG. 13, let r be the radius of the platen, n the number of nozzles in a single column and R the distance between two consecutive nozzles of a column. If α is the angle shown in FIG. 13, then the nominal distance between two consecutive nozzles of one of the columns would be R, and α would be:

$$R=r*\sin(\alpha)$$

It follows:

$$\alpha=\arcsin(R/r)$$

In general, the angle a between the central nozzle and another one positioned i times R away from this is:

$$i*R=r*\sin(\alpha)$$

resulting in:

$$\alpha=\arcsin(i*R/r)$$

The theoretical distance from a central nozzle to the nozzle +/−i is i times R, the real distance is r times α Thus the total error is:

$$\Delta e=i*R-r*\alpha$$

and the total error for the entire print head is:

$$\text{Paper_Error}=\sum_{i=0}^{n-1}\text{abs}(i*R-r*\alpha).$$

Figure 14:
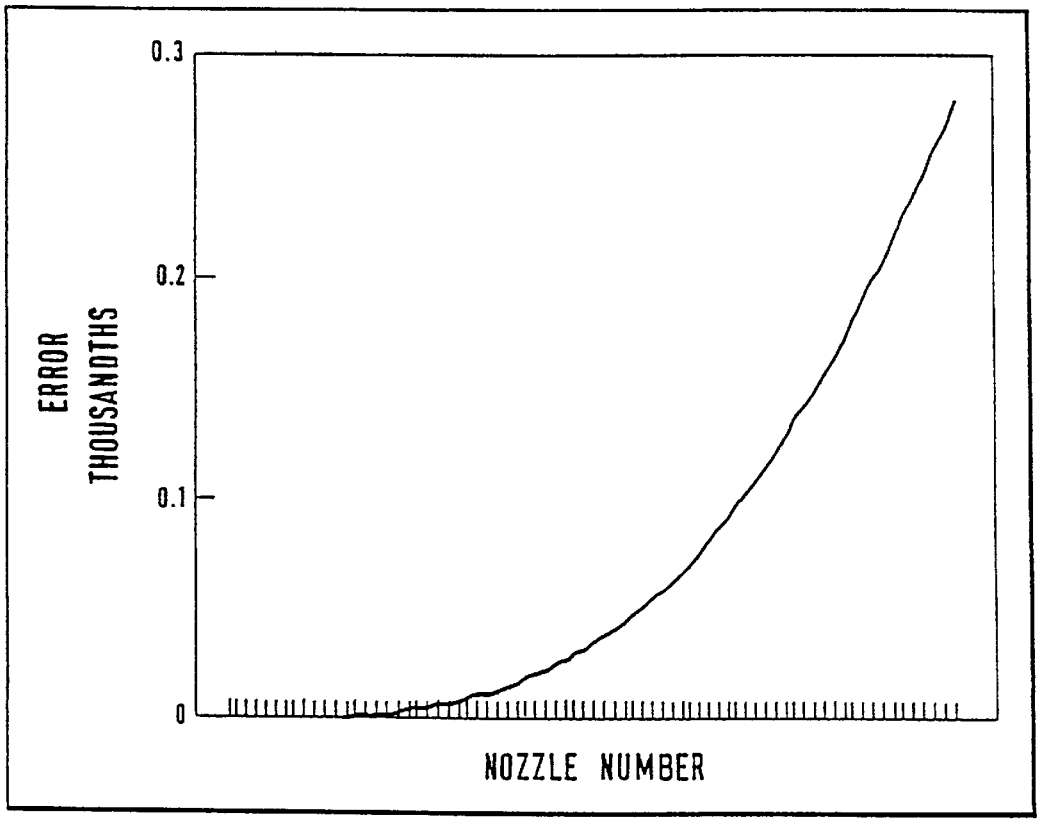
FIG. 14 is a Graphical representation of the total error for the positioning of ink dots on the medium as a function of the number of nozzles in the print head.

FIG. 14 shows the error for each of the nozzles and how it increases with the number of nozzles used: The more nozzles the print head has the greater is the total error.

A second error is caused by different flying times due to non-constant distance between nozzles and printing medium. Let h be the minimum distance between the printing medium and the print head (see FIG. 13); the following then applies for the distance di for nozzle i:

$$r+h=di+r*\cos(\alpha)$$

$$r*\sin(\alpha)=i*R$$

$$\alpha=\arcsin(i*R/r)$$

$$di=r+h-r*\cos(\alpha)=h+r*(1-\cos(\alpha))$$

Since the size of a droplet is very small and the initial velocity vd is very high, drag and gravity can be neglected. With these assumptions, the distance is equal to velocity multiplied with time, i.e.

$$s=vd*t$$

The increment in the distance is:

$$\Delta h=r*(1-\cos(\alpha)),$$

The increment in the flying time for droplet i is:

$$\Delta ti=\Delta h/vd=r*(1-\cos(\alpha))/vd$$

If vc is the velocity of the carriage, then the error would be:

$$ei=\Delta ti*vc=r*(1-\cos(\alpha))*vc/vd$$

The resulting error produced in the direction of the movement of the carriage is:

$$\text{Scan_error} = r * vc / vd * \sum_{i=0}^{n-1} (1 - \cos(\arcsin(i * R / r)))$$

Since this Scan_error occurs in a direction perpendicular to the error produced in the direction of the movement of the paper (Paper_error), the resulting total error is:

$$\text{Total_error} = \sum_{i=0}^{n-1} \sqrt{(r * vc / vd * (1 - \cos(\alpha)))^2 + (i * R - r * \alpha)^2}$$

This total error is the error for a single pass with no shingling. If there is a shingling of 50%, then the error for each pass would be $$\text{Error_per_pass} = \sum_{i=0}^{n-1} \sqrt{(r * vc / vd * (1 - \cos(\alpha)) * d)^2 + ((i * R - r * \alpha) * d)^2}$$

wherein d is the density for each pass.

The present invention provides a method for reducing this error. As explained above, the method is based on shingling, with the swath being divided in m bands in which different percentages of ink are placed. Since the error is smaller for the nozzles placed on the center of the pen, the invention increases the concentration for these nozzles and decreases the concentration for external nozzles. The formula for the error now is:

$$\text{Error} = \sum_{j=0}^{j=m} \left( \sum_{i=j*(n-1)/2}^{(j+1)*(n-1)/m-1} \sqrt{(r * vc / vd * (1 - \cos(\alpha)) * dj)^2 + ((i * R - r * \alpha) * dj)^2} \right)$$

wherein dj is the density for nozzle j.

Since these errors were calculated only for half of one column, the value for "Error" should be multiplied by 4 if the print head has two (interlaced) columns.

If the print head has two columns and the resolution is 600 dpi, R is equal to 1/300 inch since R is the distance between two consecutive nozzles.

If the two error functions, "Scan_error" and "Paper_error", were equal for all the nozzles or random, this method would not be very useful since one would introduce an extra error for the central nozzles and compensate the additional error with the outer nozzles. However, since the first derivative of the error function is positive, it is possible to compensate additional errors introduced with the errors for the outer nozzles.

According to the above equations, the best solution would be to use only one nozzle, the one that is closest to the platen and fire it with a shingle of 100% (always), then advance the paper a distance equivalent to one nozzle and repeat the process. Such a system, however, would be too slow. Thus, printing with several nozzles is preferred with appropriate selection of shingling.

In the following, an example of the method of the invention is explained wherein the swath is divided into six bands, the print head performs six passes and the medium is advanced 1/6 th after each pass. The number of print head nozzles in this example is 300, i.e. 150 for each column. In this case one can divide each half of the columns into six parts, each of them having 25 nozzles. For bands number 1 and 6 (nozzles 1 to 50 and 251 to 300) that are far away from the platen, the concentration will be 1/12; for bands 2 and 5 (nozzles 51 to 100 and 201 to 250) the concentration will be 1/6; and for bands 3 and 4 (nozzles 101 to 150 and 151 to 200) the concentration is 1/4.

With the parameters given in the following table, the total error is reduced for a single column of nozzles from 0.046023 to 0.034797, which is quite a substantial percentage reduction.

| Parameters | Value | Units | | Normal Density | Enhanced Density |
|---|---|---|---|---|---|
| vc | 18.33 | i/s | d1 | 1/6 | 1/4 |
| vd | 393.7 | i/s | d2 | 1/6 | 1/6 |
| r | 1.273 | i | d3 | 1/6 | 1/12 |
| R | 0.00333 | i | error | 0.04602 | 0.0348 |
| n | 75 | | Δe | −69.23% | |
| m | 3 | | | | |

It is understood that various modifications to the above explained embodiments are possible. The method of the invention can be used for any resolution of the print head. The number of columns of nozzles can be different from two, i.e. the number can be one or greater than two. The arrangement of the nozzles need not necessarily be in columns. The masking could be performed by software instead of hardware. Furthermore, the number of bands for shingling may be different from the number of advances of the medium. The method of the invention is also applicable to shingling not divided in bands, i.e. instead of grouping several nozzles to a band, a type of shingling is used wherein each row printed in a single pass contains a percentage of dots slightly different from the previous one. It is furthermore understood that the ejection of ink from the nozzles can be accomplished in any of a plurality of ways, for example by thermal or electrostatic methods.

I claim:

1. A method for operating an ink jet printer having a platen on which a printing medium is arranged, a printhead in proximity to the platen, said print head comprising a plurality of nozzles for ejecting ink onto the printing medium, means for moving the print head in a first direction across the printing medium and means for moving the printing medium in a second direction which is substantially perpendicular to the first direction, said method comprising the steps of:

a) depositing a swath of N bands of ink required for forming desired markings on the printing medium in several passes of the print head across said printing medium, wherein N is an integer value, said depositing, during one pass, including the substeps of:

(i) controlling ink election from subsets of nozzles of said plurality of nozzles so that only a first subset of said nozzles is activated, such that during said one pass of the printhead, a first amount of ink that is a fraction of total ink required to form the desired markings is ejected from said first subset of nozzles in a first band of the print head, whose position relative to the platen results in errors of placement of ink dots on the printing medium, and (ii) further controlling ejection of ink from a second subset of said subsets of nozzles in a second band of said N bands so that a second amount of ink that is greater than said first amount of ink is ejected therefrom, where resulting errors of placement of ink dots on the printing medium are smaller than for the first band;

b) moving the printing medium in the second direction between passes of the printhead by an amount that is less than a width of a swath; and c) repeating steps a)(i) and a)(ii) during another pass to overprint ink dots in said bands.

2. A method as recited in claim 1, wherein the nozzles in the first subset are peripheral nozzles which deposit ink onto regions of said platen that are more distant therefrom and the nozzles in the second subset are central nozzles of the printhead which deposit ink onto regions of said platen that are less distant therefrom, and wherein step b) moves said printing medium by a width of one of said N bands after each pass.

3. A method as recited in claim 1, wherein nozzles in the first subset are nozzles which deposit ink onto regions of said platen where a larger dot placement error occurs and the nozzles in the second subset are nozzles of the printhead which deposit ink onto regions of said platen where a smaller dot placement error occurs, and where step b) moves said printing medium by a width of one of said N bands after each pass.

4. A method as recited in claim 1, wherein the nozzles in the first subset are peripheral nozzles of the printhead and the nozzles in the second subset are central nozzles of the printhead, and wherein step b) moves said printing medium by a width of one of said N bands after each pass.

5. A method as in claim 3, wherein the nozzles in the first subset are peripheral nozzles of the printhead and the nozzles in the second subset are central nozzles of the printhead.

* * * * *